US011304573B2

(12) United States Patent
Diethelm et al.

(10) Patent No.: US 11,304,573 B2
(45) Date of Patent: Apr. 19, 2022

(54) CONNECTION SYSTEM FOR A SANITARY ARTICLE

(71) Applicant: GEBERIT INTERNATIONAL AG, Jona (CH)

(72) Inventors: Alois Diethelm, Vorderthal (CH); Martin Niederberger, Uznach (CH); Juanes Braulio, Wetzikon (CH); Rolf Weiss, Grüningen (CH); Maurus Zwicker, Eschenbach (CH)

(73) Assignee: GEBERIT INTERNATIONAL AG, Jona (CH)

( * ) Notice: Subject to any disclaimer, the term of this patent is extended or adjusted under 35 U.S.C. 154(b) by 66 days.

(21) Appl. No.: 16/965,525

(22) PCT Filed: Jan. 29, 2019

(86) PCT No.: PCT/EP2019/052131

§ 371 (c)(1),
(2) Date: Jul. 28, 2020

(87) PCT Pub. No.: WO2019/145569

PCT Pub. Date: Aug. 1, 2019

(65) Prior Publication Data

US 2021/0054611 A1 Feb. 25, 2021

(30) Foreign Application Priority Data

Jan. 29, 2018 (EP) ..... 18153793
Jan. 29, 2018 (EP) ..... 18153795
(Continued)

(51) Int. Cl.
*E03D 11/14* (2006.01)
*E03C 1/324* (2006.01)
(Continued)

(52) U.S. Cl.
CPC ..... *A47K 13/12* (2013.01); *E03C 1/322* (2013.01); *E03C 1/324* (2013.01); *E03D 11/125* (2013.01);
(Continued)

(58) Field of Classification Search
CPC ..... E03C 1/132; E03C 1/322; E03C 1/324; E03D 11/125; E03D 11/14; E03D 11/17; E03D 11/143
(Continued)

(56) References Cited

U.S. PATENT DOCUMENTS 1,545,839 A 7/1925 Mason
3,251,073 A 5/1966 Rawson
(Continued)

FOREIGN PATENT DOCUMENTS

DE 28 09 135 A 9/1979
DE 20 2008 002 171 U1 7/2009
(Continued)

OTHER PUBLICATIONS

Communication dated Aug. 22, 2018 by the European Patent Office in application No. 18 15 3796.
(Continued)

*Primary Examiner* — Huyen D Le
(74) *Attorney, Agent, or Firm* — Sughrue Mion, PLLC

(57) ABSTRACT

A connection device for connecting a sanitary article to a connection structure which is fixedly predefined on site and which has at least one conduit which is arranged in a positionally fixed manner on site. The device comprises a bearing element having at least one bearing-side pipeline portion, which pipeline portion is arranged on the bearing element and is configured for water-conducting connection to the positionally fixedly arranged on-site conduit and for water-conducting connection to a sanitary-article-side con-
(Continued)

nection point. For the adjustment of the position, in particular of the height position, of the sanitary article with respect to the connection structure which is fixedly predefined on site, the bearing element is arranged displaceable on the sanitary article such that it can be displaced along an adjustment movement relative to the sanitary article.

15 Claims, 4 Drawing Sheets

(30) Foreign Application Priority Data

Jan. 29, 2018 (EP) ..... 18153796
Jan. 29, 2018 (EP) ..... 18153797

(51) Int. Cl.
*E03C 1/322* (2006.01)
*A47K 13/12* (2006.01)
*E03D 11/12* (2006.01)
*E03D 11/16* (2006.01)
*E03D 11/17* (2006.01)

(52) U.S. Cl.
CPC ..... *E03D 11/143* (2013.01); *E03D 11/16* (2013.01); *E03D 11/17* (2013.01)

(58) Field of Classification Search
USPC ..... 4/252.1
See application file for complete search history.

(56) References Cited

U.S. PATENT DOCUMENTS

| | | | | |
|---|---|---|---|---|
| 4,091,473 | A * | 5/1978 | Matthews | E03D 11/125 4/300 |
| 8,141,177 | B1 * | 3/2012 | Majocka | E03D 11/14 4/252.3 |
| 9,464,426 | B1 * | 10/2016 | Schaetzke | E03D 11/14 |
| 2004/0133969 | A1 * | 7/2004 | Akin | E03D 11/14 4/252.2 |
| 2014/0310860 | A1 | 10/2014 | Wroblewski et al. | |
| 2016/0090726 | A1 * | 3/2016 | Verdecchia | F16L 41/08 4/252.1 |

FOREIGN PATENT DOCUMENTS

| | | |
|---|---|---|
| GB | 2 223 042 A | 3/1990 |
| GB | 2 248 389 A | 4/1992 |
| NL | 1021887 C1 | 5/2004 |

OTHER PUBLICATIONS

International Search Report for PCT/EP2019/052131 dated Apr. 25, 2019 [PCT/ISA/210].
Written Opinion for PCT/EP2019/052131 dated Apr. 25, 2019 [PCT/ISA/237].

* cited by examiner

CONNECTION SYSTEM FOR A SANITARY ARTICLE

CROSS REFERENCE TO RELATED APPLICATIONS

This application is a National Stage of International Application No. PCT/EP2019/052131 filed Jan. 29, 2019, claiming priority based on European Patent Application Nos. 18153796.0 filed Jan. 29, 2018, 18153793.7 filed Jan. 29, 2018, 18153795.2 filed Jan. 29, 2018 and 18153797.8 filed Jan. 29, 2018.

TECHNICAL FIELD

The present invention relates to a connection device for a sanitary article according to the preamble of claim 1.

PRIOR ART

Connection devices for sanitary articles, such as, for example, toilet bowls or wash basins, are known from the prior art. By way of example, WO 2010/143965 discloses a corresponding device.

Further, the arrangement of an assembly frame or similar assembly element behind the wall is known from the prior art, with the height of the water conduits and other fastening elements being adjustable on said assembly elements. For example, by way of adjustable foot supports of the assembly frame or simply by way of an arrangement of the assembly element at different heights.

A disadvantage is that, after assembly of the front wall, behind which the assembly frame or the assembly element is located, an adjustment of the height of the connections and thus also of the sanitary article is no longer possible, or only possible with a very great outlay. However, such an adjustment is desirable so that further technical factors, such as the thickness of the floor structure in a bathroom, which cannot be predicted directly, or user desires can be taken into account.

SUMMARY OF THE INVENTION

Proceeding from said prior art, the invention is based on an object of specifying a connection device for a sanitary article, which device overcomes the disadvantages of the prior art. In particular, it is an object of the present invention to specify a connection device which permits the adjustment of the height, position of the sanitary article during the assembly of same.

Said object is achieved by the subject matter of claim 1. Accordingly, a connection device is used to connect a sanitary article to a connection structure which is fixedly predefined on site and which has at least one conduit which is arranged in a positionally fixed manner on site. The connection device comprises a bearing element having at least one bearing-side pipeline portion, which pipeline portion is arranged on the bearing element and is configured for water-conducting connection to the positionally fixedly arranged on-site conduit and for water-conducting connection to a sanitary-article-side connection point. For the adjustment of the position, in particular of the height position, of the sanitary article with respect to the connection structure which is fixedly predefined on site, the bearing element can be arranged on the sanitary article such that it can be displaced along an adjustment movement relative to the sanitary article. That is to say that the bearing element can be displaced with respect to the sanitary article and is arranged on the sanitary article. As a result of the displacement, it is possible for the height position of the sanitary article to be adjusted without adversely affecting the connection between the on-site conduit and the pipeline portion. That is to say that, in the installation position, the bearing element, independently of the height position of the sanitary article, lies at that height which corresponds to the connection structure. On account of the displaceability between the bearing element and the sanitary article, the bearing element can be arranged in a non-displaceable manner with respect to the connection structure.

The connection device has the advantage that the height position of the sanitary article can be adjusted in a simple manner, and in particular after installation of the connection structure has been completed. In this way, the height position of the sanitary article can be adjusted independently of the height of the connection structure.

With respect to the prior art, the advantage is further afforded that the elements relevant to the height adjustment of the sanitary article are no longer hidden behind a wall but rather, on account of the connection to the sanitary article, are accessible iron that side of the wall on which the sanitary article is to be arranged.

The connection structure which is predefined on site is configured to fit with the connection structure on that, side of the bearing element which faces the connection structure. The connection structure of the bearing element has at least the bearing-side pipeline portion. On account of the fitting design, simple connection of the connection device is possible, with a simple height adjustment being made possible at the same time on account of the displaceability of the sanitary article relative to the bearing element.

The term "sanitary article" is a toilet bowl, a urinal, a wash basin, a bidet or any other type of sanitary articles which are arranged with a wall and corresponding connection structures.

The wording "displaceably arrangeable" with respect to the connection between the sanitary article and the bearing element is understood to mean that the connection is such that the sanitary article and the bearing element are connected to one another, with the connection allowing the two elements to be displaced relative to one another.

The adjustment movement between the sanitary article and the bearing element is preferably a guided movement. Preferably, the bearing element and the sanitary article are connected to one another by way of a guide, in particular by way of a longitudinal guide, with said adjustment movement being able to be executed by way of the guide.

Preferably, the connection device further comprises at least one fastening point which is arranged on the bearing element, which fastening point is configured for receiving a fastening element of the connection structure, said fastening element being arranged in a positionally fixed manner on site, wherein the fastening point is at a fixed distance from the at least one pipeline portion.

The fastening element which is arranged in a positionally fixed manner on site is part of the on-site connection structure. Particularly preferably, the fastening element which is arranged in a positionally fixed manner on site is a threaded rod.

Preferably, the fastening point on the bearing element has a thread which can be brought into engagement with the threaded rod. By way of said engagement, the sanitary article can then be fastened to the wall. The thread can be part of a threaded element which is placed in the fastening point.

Particularly preferably, two mutually spaced-apart fastening points are arranged. In this case, the two fastening points lie in particular at the sane height.

Said at least one fastening point lies in the bearing element at a fixed distance from the at least one pipeline portion. On site, the fastening element is then likewise at an identical position or at an identical distance with respect to the conduit which is arranged in a positionally fixed manner on site.

However, as an alternative, the sanitary article can also be connected to the wall in some other way. In said alternatives, the bearing element has no fastening point. The fastening points are then integrated on the sanitary article. By way of example, mention is made of elongate holes or other openings through which a threaded element can be guided.

Preferably, the bearing element, after adjustment, of the position thereof with respect to the sanitary article has been completed, can be fixedly connected to the sanitary article. In this way, the bearing element is fixed with respect to the sanitary article.

Particularly preferably, the fixed connection between the bearing element and the sanitary article is a mechanically fixed connection, wherein the mechanically fixed connection is preferably a positively locking and/or force-fitting connection.

Preferably, the pipeline portion has a compensation portion, with which compensation portion an adjustment offset, which results during the adjustment movement between the bearing element and the sanitary article, between the at least one bearing-side pipeline portion and the sanitary-article-side connection point can be compensated. In this way, provided that there is a simple displaceability of the bearing element and thus a simple adjustability in terms of height, a particularly simple and in particular water-tight connection between the pipeline portion and the sanitary article can be provided.

In a first variant, the compensation portion is provided by a deflecting portion in the pipeline portion and by a pivotable mounting of the pipeline portion in the bearing point on the bearing element, wherein, during the height adjustment, the pipeline portion is pivoted in the bearing point. Particularly preferably, in the region of the inlet into the sanitary-article-side connection point, the pipeline portion is mounted with a seal in the flushing water inflow and in the waste water outflow, respectively, which seal is configured in such a way that a displacement of the pipeline portion transversely with respect to the center axis of the sanitary-article-side connection point can be accommodated.

In a second variant, the compensation portion in the pipeline portion is configured in the form of a flexibly deformable pipe portion, which flexible deformable pipe portion is preferably a corrugated bellows or a rubber bellows.

Preferably, the bearing element is mounted in a displaceable manner on a support element which can be fixedly connected to the sanitary article, and can be connected to the sanitary article by way of the support element. The support element is fixedly connected to the sanitary article. As an alternative thereto, the support element can also be omitted, with the bearing element then being connected directly to the sanitary article.

Preferably, the bearing element and the support element are connected to one another by way of at least one longitudinal guide.

Preferably, two longitudinal guides which are arranged at a spacing from one another are present.

Preferably, in the installation position, at least one of the longitudinal guides is oriented in the vertical and/or at least a further one of the longitudinal guides is oriented in the horizontal.

In a particularly preferred embodiment, two pipeline portions are mounted at a fixed distance with respect to one another on the bearing element, of which one of the pipeline portions is a flushing water conduit and the other of the pipeline portions is a waste water conduit. In said embodiment, the on-site connection structure then likewise has two on-site conduits, namely a fresh water conduit for feeding the flushing water conduit and a waste water conduit, which is connected to the waste water conduit of the connection device. The axial distance between the two on-site conduits corresponds to the axial distance between the two pipeline portions. Two sanitary-article-side connection points are then also arranged. Preferably, the axial distance between the two pipeline portions is greater than the axial distance between the two sanitary-article-side connection points. The difference between the two axial distances preferably corresponds to the maximum offset of the height adjustment.

In said particularly preferred embodiment, two fastening points are arranged on the sanitary article side, which points are at a fixed distance from the two pipeline portions. On site, two fastening elements which are arranged in a positionally fixed manner are likewise arranged.

In said particularly preferred embodiment, for the fastening of a wall-mounted toilet bowl, the distances and position of the two pipeline portions and of the two fastening points preferably correspond to DIN standard DIN EN 33:2011-11. Similarly, the distances and position of the on-site conduits and of the two on-site fastening elements preferably correspond to DIN standard DIN EN 33:2011-11.

In other particularly preferred embodiments, the distances and position of said elements correspond to the DIN standard which is appropriate for the sanitary article.

A connection system comprises a connection device according to the description above and a connection structure which is fixedly predefined on site and which has at least one conduit which is arranged in a positionally fixed manner on site, wherein the relative position of the individual elements of the connection structure among one another have predefined positions, and in that the positions of the corresponding elements of the bearing element are identical to the positions of the connection structure.

Particularly preferably, the connection structures on the sanitary article side and on site are configured in accordance with the DIN standards mentioned above.

An arrangement comprises a sanitary article having a receiving space and having a connection device according to the description above, wherein the connection device is arranged in the receiving space of the sanitary article.

Preferably, said compensation portion of the pipeline portion lies within the receiving space of the toilet bowl.

Particularly preferably, the compensation portion lies between the bearing element and the sanitary-article-side connection point.

Preferably, the receiving space is configured to be open with respect to the wall to which the sanitary article is to be fastened.

A method for assembling a connection device or an arrangement as claimed in one of the preceding claims is characterized in that, in a first step, the bearing element is connected to the sanitary article, optionally by way of the support element, wherein the at least one pipeline portion of the bearing element is connected to the sanitary-article-side connection point;

in that, in a second step, the sanitary article is displaced relative to the bearing element, such that the height of the sanitary article can be adjusted; and in that, in a third step, the bearing-side pipeline portion is connected to the conduit which is arranged in a positionally fixed manner on site.

Preferably, in the third step, the sanitary article is fixedly connected to the wall, in particular, in the third step, the bearing-side fastening point is connected to the on-site fastening element.

With the compensation portion being present, the compensation portion deforms, and compensates, in accordance with the offset between the bearing element and the sanitary article.

After adjustment of the height position has been completed, the bearing element is connected to the sanitary article or the in a positively locking and/or force-fitting and/or frictionally locking manner.

Further embodiments are specified in the dependent claims.

BRIEF DESCRIPTION OF THE DRAWINGS

Preferred embodiments of the invention are described below with reference to the drawings, which serve merely for elucidation and are not to be interpreted as limiting. In the drawings.

DESCRIPTION OF PREFERRED EMBODIMENTS

Figure 1:
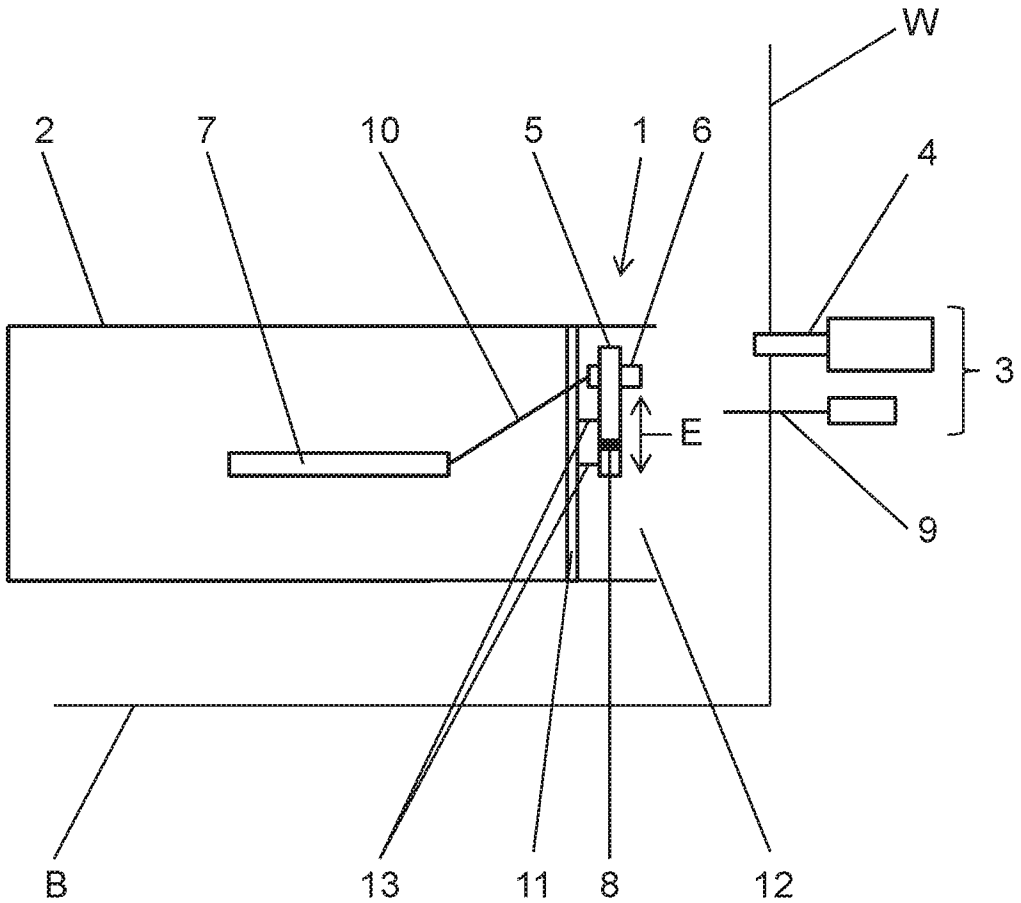
FIG. 1 shows a schematic view of a sanitary article with a connection device according to a first embodiment.
Figure 2:
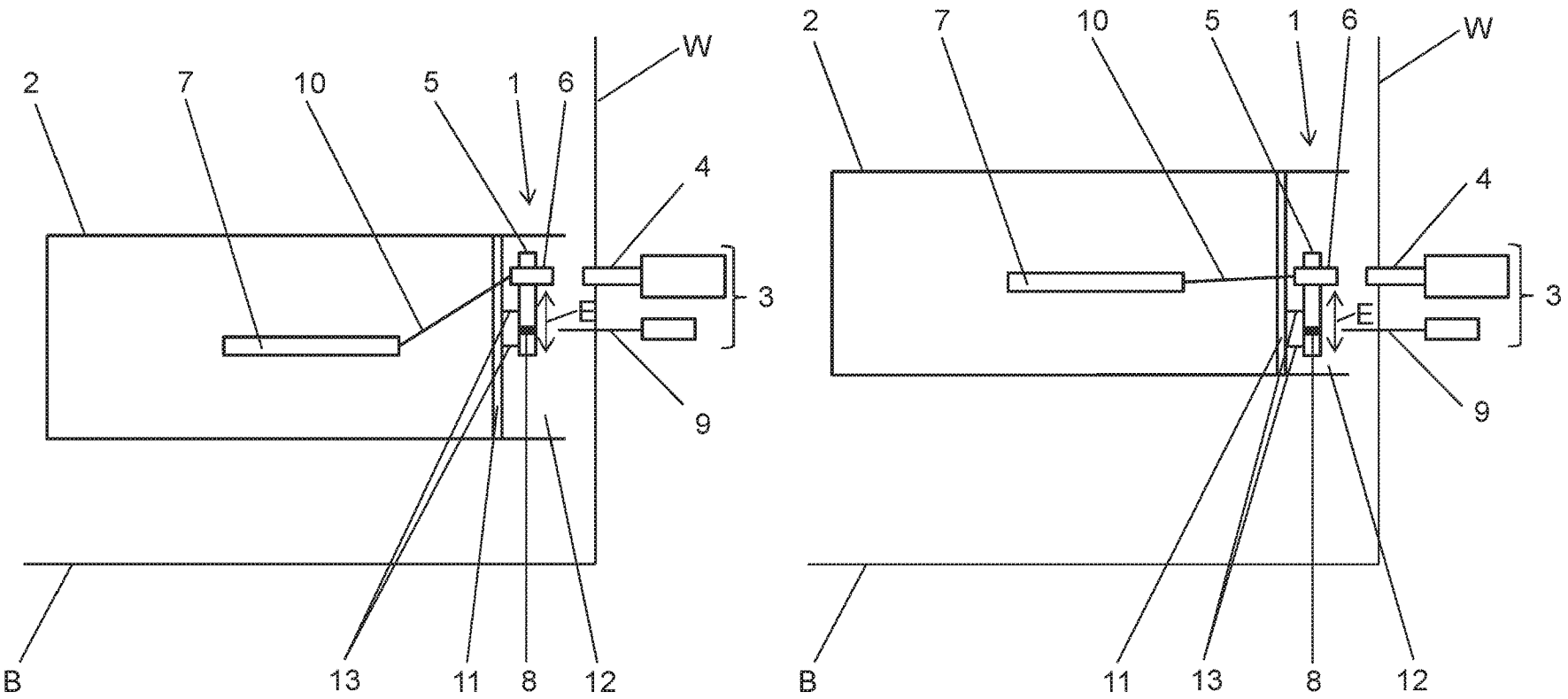
FIG. 2 shows two views of the sanitary article according to FIG. 1 at different height positions prior to assembly.
Figure 3:
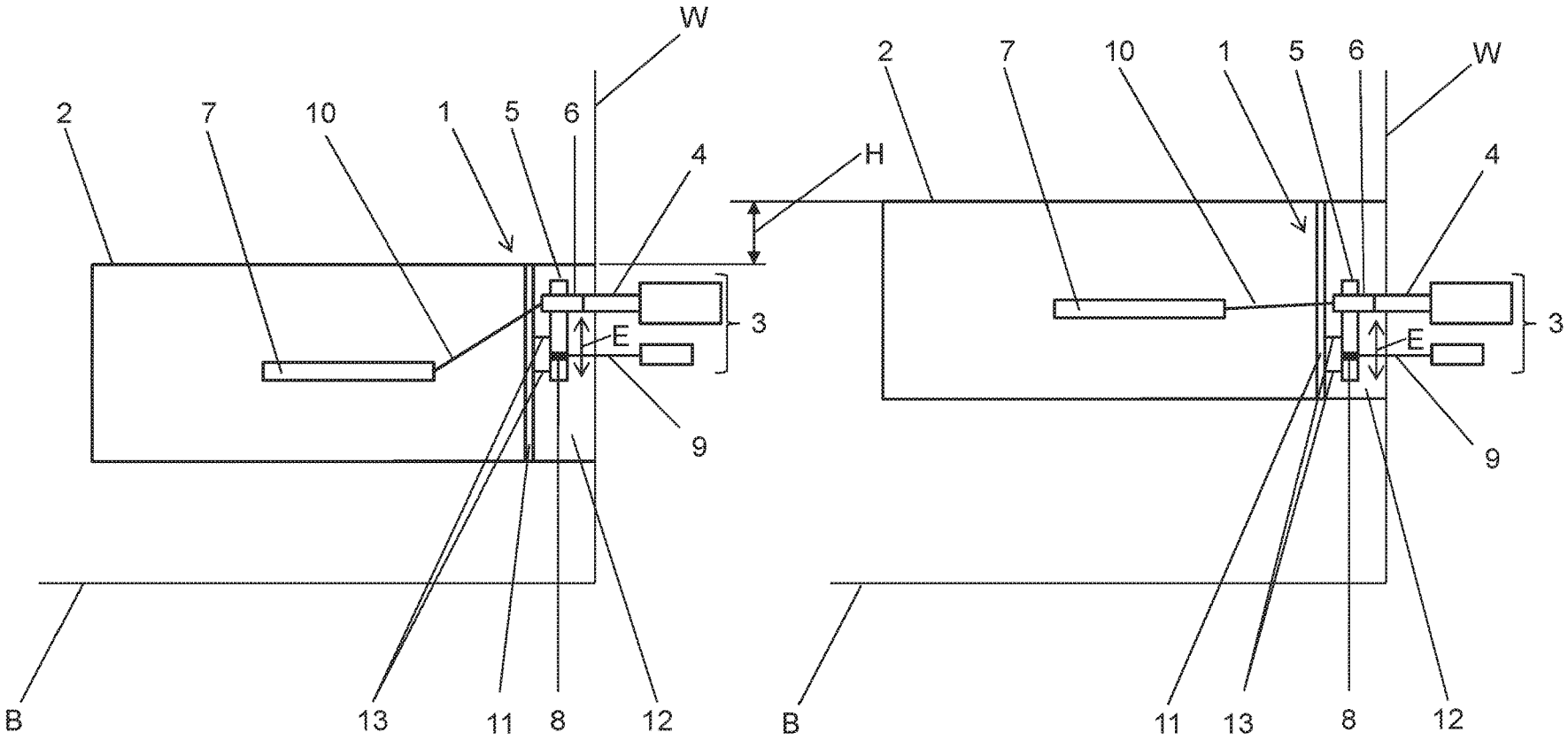
FIG. 3 shows two views of the sanitary article according to FIG. 1 at different height positions after assembly.
Figure 4:
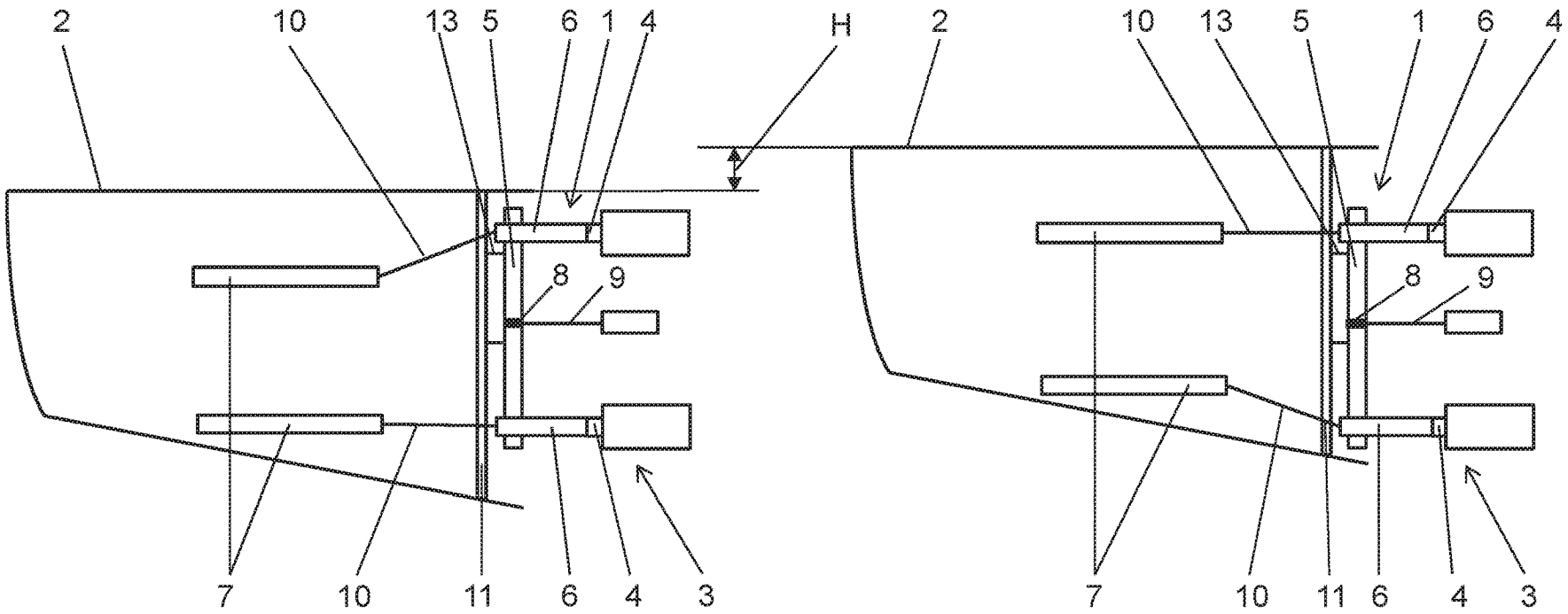
FIG. 4 shows two views of a sanitary article with a connection device according to a second embodiment.

In FIGS. 1 to 4, schematic views of a connection device 1 are shown. FIGS. 1 to 3 in this case show a first embodiment and FIG. 4 shows a second embodiment of the connection device 1.

The connection device 1 is used to connect a sanitary article 2 to a connection structure 3 which is fixedly predefined on site. The connection structure 3 which is fixedly predefined on site projects away from a wall W. The sanitary article 2 is to be assembled at a distance from the floor B, wherein, with the connection device 1 and the interaction thereof with the sanitary article 2 or with the on-site connection structure 3, the height position of the sanitary article can be adjusted toward the floor B. The adjustment movement bears the reference sign E.

In the embodiments shown, the connection structure 3 which is fixedly predefined on site comprises at least one conduit A which is arranged in a positionally fixed manner on site and a fastening element 9 which is arranged in a fixed manner on site. In the embodiment of FIGS. 1 to 3, only one conduit is shown, and in the embodiment of FIG. 4, two conduits are shown. In other embodiments which are not shown, the fastening element can be dispensed with, with the on-site connection structure 2 then comprising only a single conduit. In said embodiment, the fastening is released by way of other elements.

The connection device 1 comprises a bearing element 5 having at least one bearing-side pipeline portion 6. The number of bearing-side pipeline portions 6 corresponds to the number of on-site conduits 4. The bearing-side pipeline portion 6 is mounted on the bearing element 5 and is used for water-conducting connection to the positionally fixedly arranged on-site conduit 4 and for water-conducting connection to a sanitary-article-side connection point 7. In the embodiment shown, the bearing element 5 further comprises at least one fastening point 8. The at least one fastening point 8 is used for receiving the at least one fastening element 9 which is arranged in a positionally fixed manner on site. By way of said connection, the sanitary article 2 is connected to the wall W in a mechanically fixed manner. The at least, one fastening point 3 is arranged on the bearing element 5 at a fixed or determined distance from the at least one pipeline portion 6.

For the adjustment of the height position of the sanitary article 2 with respect to the connection structure 3 which is fixedly predefined on site or with respect to the floor B, the bearing element 5 is arranged, or mounted, on the sanitary article 2 in a displaceable manner. The bearing element 5 can accordingly be displaced relative to the sanitary article 2, or the sanitary article 2 can be displaced relative to the bearing element 5. Said displaceability is now explained in greater detail with reference to FIG. 2. In the schematic depiction of FIG. 2, on the left-hand side, the bearing element 2 is shown in the uppermost position thereof with respect to the sanitary article 2. The sanitary article 2 is located in the lowermost position. The sanitary article 2 can then be displaced relative to the bearing element 5. In the variant shown, the sanitary article is displaced upward. In FIG. 2, on the right-hand side, the sanitary article 2 is located in the uppermost position thereof. As is evident, the height of the sanitary article 2 with respect to the floor B is adjusted as a result of said displaceability. While the sanitary article 2 can be displaced with respect to the floor B and the connection structure 3, and also with respect to the bearing element 5, the bearing element 3 is at a fixed position with respect to the connection structure 3. This has the advantage that the sanitary technology connection between the on-site conduit 4 and the bearing-side pipeline portion 6 can always be effected under the same conditions. Displaceability is not necessary here.

On the sanitary article 2 side, an adjustment offset arises between the pipeline portion 6 and the sanitary-article-side connection point 1. Said adjustment offset can be compensated by a compensation portion 10, which is part of the pipeline portion 6. Other types of compensation are also conceivable. In the embodiment shown, the pipeline portion 6 comprises the aforementioned compensation portion 10. The compensation portion 10 compensates for the adjustment offset between the bearing element 5 and the sanitary-article-side connection point 7.

In both embodiments, the sanitary engineer can deal with the height position of the sanitary article in situ, independently of the height of the on-site connection structure 3. After the adjustment of the relative position between the sanitary article 2 and the bearing element 5 has been completed, the sanitary engineer can then effect the connection of the bearing-side pipe portion 6 with respect to the conduit 4 which is arranged in a positionally fixed manner on site and the connection between the fastening point 8 and the fastening element 9, as is shown in FIG. 3. In this way, the sanitary article 2 is fixedly arranged with respect to the wall W.

After adjustment of the position of the bearing element 5 with respect to the sanitary article 2 has been completed, said bearing element is fixedly connected to the sanitary article 2. Said fixed connection between the bearing element 5 and the sanitary article 2 is preferably a mechanically fixed connection. In particular, a positively locking and/or force-fitting connection. A screw or clamping connection is particularly preferred.

In the embodiment shown, the bearing element 5 is connected to the sanitary article 2 indirectly by way of a support element 11. The connection between the support element 11 and the bearing element 5 hears the reference sign 13. In this case, the support element 11 is fixedly connected to the sanitary article 2. By way of example, the support element 11 can be a type of frame element, which is fixedly installed in a receiving space 12 of the sanitary article 2 or is fixedly integrated on the sanitary article 2.

The bearing element 5 is connected to the support element 11 in a displaceable manner. Preferably, the bearing element 5 and the support element 11 are connected by way of at least one longitudinal guide. The displaceability between the sanitary article 2 and the bearing element 5 is obtained by way of said longitudinal guide.

In the embodiment shown according to FIGS. 1 to 4, the longitudinal guide between the support element 11 and the bearing element 5 or between the bearing element 5 and the sanitary article 2 is oriented substantially in the vertical V. That is to say, it is substantially possible to adjust the sanitary article 2 in the vertical direction. However, it is also conceivable for the longitudinal guide to be oriented in the horizontal or for other types of guides to be provided, such that the position of the sanitary article 2 can be adjusted.

In FIG. 4, a further embodiment of the connection device 1 is then shown. Here, the sanitary article 2 is configured for example in the form of a toilet or a urinal or a wash basin, with two pipeline portions 6 being mounted at a fixed distance with respect to one another on the bearing element 5. One of the pipeline portions is used to supply fresh water and the other one of the two pipeline portions represents a waste water conduit. On the on-site connection structure side, two conduits 4 are likewise arranged, namely a fresh water conduit and a waste water conduit. The fresh water conduit is connected to the upper pipeline portion and the waste water conduit is connected in this case to the lower pipeline portion.

Further, a fastening point 8 is likewise arranged on the bearing element 5. The fastening point 8, in turn, is connected to a fastening element 9.

However, the connection structure 3 could also have more than just one fastening element 9, with additional fastening points 8 then being arranged on the bearing element 5.

The fastening point 8 and the two pipeline portions 6 are arranged on the bearing element 5 at determined positions with respect to one another. Similarly, on the connection structure 3 side, the two conduits 4 and the at least one on-site fastening element 9 are arranged at fixed distances with respect to one another.

FIGS. 3 and 4 furthermore illustrate the height offset H between the lowermost and the uppermost position of the sanitary article 2.

LIST OF REFERENCE SIGNS

1 Connection device
2 Sanitary article
3 On-site connection structure
4 On-site conduit
5 Bearing element
6 Pipeline portion
7 Sanitary-article-side connection point
8 Fastening point
9 On-site fastening element
10 Compensation portion
11 Support element
12 Receiving space
13 Connection
B Floor
W Wall
E Adjustment movement

The invention claimed is:

1. A connection device for connecting a sanitary article to a connection structure which is fixedly predefined on site and which has at least one conduit which is arranged in a positionally fixed manner on site, comprising a bearing element having at least one bearing-side the pipeline portion, wherein said pipeline portion is arranged on the bearing element and is configured for water-conducting connection to the positionally fixedly arranged on-site conduit and for water-conducting connection to a sanitary-article-side connection point, and wherein, for the adjustment of the position, in particular of the height position, of the sanitary article with respect to the connection structure which is fixedly predefined on site, the bearing element is arranged displaceable on the sanitary article such that it can be displaced along an adjustment movement relative to the sanitary article.

2. The connection device as claimed in claim 1, wherein the connection device further comprises at least one fastening point which is arranged on the bearing element, which fastening point is configured for receiving a fastening element of the connection structure, said fastening element being arranged in a positionally fixed manner on site, wherein the fastening point is at a fixed distance from the at least one pipeline portion.

3. The connection device as claimed in claim 1, wherein the bearing element, after adjustment of the position thereof with respect to the sanitary article has been completed, can be fixedly connected to the sanitary article.

4. The connection device as claimed in claim 3, wherein the fixed connection between the bearing element and the sanitary article is a mechanically fixed connection, wherein the mechanically fixed connection is preferably a positively locking and/or force-fitting connection.

5. The connection device as claimed in claim 1, wherein the pipeline portion has a compensation portion, with which compensation portion an adjustment offset, which results during the adjustment movement between the bearing element and the sanitary article, between the at least one bearing-side pipeline portion and the sanitary-article-side connection point can be compensated.

6. The connection device as claimed in claim 1, wherein the bearing element is mounted in a displaceable manner on a support element which can be fixedly connected to the sanitary article, and can be connected to the sanitary article by way of the support element.

7. The connection device as claimed in claim 6, wherein the bearing element and the support element are connected to one another by way of at least one longitudinal guide.

8. The connection device as claimed in claim 6, wherein the bearing element and the support element are connected to one another by way of at least one longitudinal guide and wherein in the installation position, at least one of the longitudinal guides is oriented in the vertical and/or at least a further one of the longitudinal guides is oriented in the horizontal.

9. The connection device as claimed in claim 1, wherein two pipeline portions are mounted at a fixed distance with respect to one another on the bearing element, of which one of the pipeline portions is a flushing water conduit and the other of the pipeline portions is a waste water conduit.

10. A connection system comprising a connection device and a connection structure, said connection device comprises a bearing element having at least one bearing-side pipeline portion, which pipeline portion is arranged on the bearing element and is configured for water-conducting connection to the positionally fixedly arranged on-site conduit and for water-conducting connection to a sanitary-article-side connection point, wherein said connection structure is fixedly predefined on site and has at least one conduit which is arranged in a positionally fixed manner on site, wherein, for the adjustment of the position, in particular of the height position, of the sanitary article with respect to the connection structure which is fixedly predefined on site, the bearing element is arranged displaceable on the sanitary article such that it can be displaced along an adjustment movement relative to the sanitary article, and wherein the relative position of the individual elements of the connection structure among one another have predefined positions, and wherein the positions of the corresponding elements of the bearing element are identical to the positions of the connection structure.

11. An arrangement comprising a sanitary article having a receiving space and a connection device, wherein said connection device is provided for connecting the sanitary article to a connection structure which is fixedly predefined on site and which has at least one conduit which is arranged in a positionally fixed manner on site, wherein said connection device comprises a bearing element having at least one bearing-side pipeline portion, which pipeline portion is arranged on the bearing element and is configured for water-conducting connection to the positionally fixedly arranged on-site conduit and for water-conducting connection to a sanitary-article-side connection point, wherein, for the adjustment of the position, in particular of the height position, of the sanitary article with respect to the connection structure which is fixedly predefined on site, the bearing element is arranged displaceable on the sanitary article such that it can be displaced along an adjustment movement relative to the sanitary article, and wherein the connection device is arranged in the receiving space.

12. The arrangement as claimed in claim 11, wherein the receiving space is configured to be open with respect to the wall to which the sanitary article is to be fastened.

13. A method for assembling a connection device comprising a bearing element having at least one bearing-side pipeline portion, which pipeline portion is arranged on the bearing element and is configured for water-conducting connection to the positionally fixedly arranged on-site conduit and for water-conducting connection to a sanitary-article-side connection point, wherein, for the adjustment of the position, in particular of the height position, of the sanitary article with respect to the connection structure which is fixedly predefined on site, the bearing element is arranged displaceable on the sanitary article such that it can be displaced along an adjustment movement relative to the sanitary article, wherein, in a first step, the bearing element is connected to the sanitary article, optionally by way of the support element, wherein the at least one pipeline portion of the bearing element is connected to the sanitary-article-side connection point, wherein, in a second step, the sanitary article is displaced relative to the bearing element, such that the height of the sanitary article can be adjusted, and wherein, in a third step, the bearing-side pipeline portion is connected to the conduit which is arranged in a positionally fixed manner on site.

14. The method as claimed in claim 13, wherein, in the third step, the sanitary article is fixedly connected to the wall, in particular wherein, in the third step, the bearing-side fastening point is connected to the on-site fastening element.

15. The method as claimed in claim 13, wherein after adjustment of the height position has been completed, the bearing element is connected to the sanitary article or the support element in a positively locking and/or force-fitting and/or frictionally locking manner.

* * * * *